US009945104B2

(12) United States Patent
Wang et al.

(10) Patent No.: US 9,945,104 B2
(45) Date of Patent: Apr. 17, 2018

(54) INTEGRALLY FORMED SENSOR TYPE FAUCET LIQUID SOAP DISPENSER

(71) Applicant: Xiamen Runner Industrial Corporation, Xiamen (CN)

(72) Inventors: Jun-Sheng Wang, Xiamen (CN); Xi-Min Chen, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 15/295,808

(22) Filed: Oct. 17, 2016

(65) Prior Publication Data

US 2017/0107704 A1 Apr. 20, 2017

(30) Foreign Application Priority Data

Oct. 20, 2015 (CN) ..... 2015 2 0809993 U

(51) Int. Cl.

| | |
|---|---|
| ***E03C 1/04*** | (2006.01) |
| ***E03C 1/05*** | (2006.01) |
| ***A47K 5/12*** | (2006.01) |
| ***A47K 5/14*** | (2006.01) |

(52) U.S. Cl.

CPC ..... *E03C 1/0404* (2013.01); *A47K 5/1211* (2013.01); *A47K 5/1217* (2013.01); *A47K 5/14* (2013.01); *E03C 1/057* (2013.01); *A47K 2005/1218* (2013.01)

(58) Field of Classification Search

CPC ..... E03C 1/0404; E03C 1/057; A47K 5/14; A47K 5/1211; A47K 5/1217; A47K 2005/1218

See application file for complete search history.

(56) References Cited

U.S. PATENT DOCUMENTS

| | | | | |
|---|---|---|---|---|
| 6,206,241 | B1 * | 3/2001 | Terrell | A47K 5/1204 222/129.2 |
| 7,228,874 | B2 * | 6/2007 | Bolderheij | E03C 1/04 137/801 |
| 7,364,053 | B2 * | 4/2008 | Ophardt | A47K 5/16 137/801 |
| 7,458,523 | B2 * | 12/2008 | Hyslop | E03C 1/0404 137/624.14 |
| 9,777,468 | B2 * | 10/2017 | Burgo, Sr. | E03C 1/0404 |
| 2013/0175296 | A1 * | 7/2013 | Gray | A47K 5/1207 222/135 |

(Continued)

*Primary Examiner* — Frederick C Nicolas

(74) *Attorney, Agent, or Firm* — Chun-Ming Shih

(57) ABSTRACT

An integrally formed sensor type faucet liquid soap dispenser includes a faucet main body provided with an upper surface, a lower surface, a side surface, and a rear surface. The faucet main body further includes: a water output sensor window, disposed on the lower surface at a water output end of the faucet main body, and having the water output sensor provided inside; and a liquid soap output sensor window, disposed on the upper surface or the rear surface at the water output end of the faucet main body, and having the liquid soap output sensor provided inside. The water output port and the liquid soap output port are both disposed on the lower surface at the water output end of the faucet main body, such that water output port and liquid soap output port are adapted to output water and liquid soap respectively through using an interlock circuit.

2 Claims, 3 Drawing Sheets

(56) References Cited

U.S. PATENT DOCUMENTS

| | | | | |
|---|---|---|---|---|
| 2015/0083748 | A1* | 3/2015 | McHale | E03C 1/057 222/52 |
| 2015/0101121 | A1* | 4/2015 | Burgo, Sr. | E03C 1/0404 4/668 |
| 2015/0223646 | A1* | 8/2015 | Wegelin | A47K 5/1211 222/1 |
| 2015/0259890 | A1* | 9/2015 | Shirai | E03C 1/057 4/668 |
| 2016/0069052 | A1* | 3/2016 | Burgo, Sr. | E03C 1/0404 222/133 |

* cited by examiner

INTEGRALLY FORMED SENSOR TYPE FAUCET LIQUID SOAP DISPENSER

BACKGROUND OF THE INVENTION

Field of the Invention

The present invention relates to liquid soap dispenser, and in particular to an integrally formed sensor type faucet liquid soap dispenser.

The Prior Arts

Presently on the market, a sensor type faucet and a sensor type liquid soap dispenser are installed and disposed separately, so that two installations are required. However, in this approach, two faucet-like products are presented on a basin table, giving an appearance not neat, clean, and simple enough. In this respect, the existing integrally formed sensor type liquid soap dispenser is apt to have the problem of mutual interferences while performing sensing, so it is not practical in application.

Therefore, presently, the design and performance of the faucet liquid soap dispenser is not quite satisfactory, and it leaves much room for improvement.

SUMMARY OF THE INVENTION

In view of the problems and drawbacks of the prior art, the present invention provides an integrally formed sensor type faucet liquid soap dispenser, that is novel in design, compact in structure, and is adapted to output water or liquid soap using only one faucet main body.

The major objective of the present invention is to provide an integrally formed sensor type faucet liquid soap dispenser, comprising: a faucet main body. The faucet main body includes: a liquid soap pump; a liquid soap bottle, with its output connected to a first input of the liquid soap pump; an air pump; a foaming device, with its first input connected to an output of the liquid soap pump, and with its second input connected to an output of the air pump, while an output of the foaming device is connected to a liquid soap output port; a liquid soap output sensor; a water output sensor; a water input tube; a water output tube, connected to a water output port; an electric magnetic valve, with its second input connected to the water input tube, and with its output connected to the water output tube; a main control, connected to a second input of the liquid soap pump, an input of the air pump, an input of the water output sensor, an input of the liquid soap output sensor, a first input of the electric magnetic valve; and a power supply, connected to the main control.

In an aspect of the present invention, the faucet main body is provided with an upper surface, a lower surface, a side surface, and a rear surface. The faucet main body further includes: a water output sensor window, disposed on the lower surface at a water output end of the faucet main body, and having the water output sensor provided inside; and a liquid soap output sensor window, disposed on the upper surface or the rear surface at the water output end of the faucet main body, and having the liquid soap output sensor provided inside. The water output port and the liquid soap output port are both disposed on the lower surface at the water output end of the faucet main body, such that the water output port and the liquid soap output port are adapted to output water and liquid soap respectively through using an interlock circuit. As such, water and liquid soap will not be output at the same time.

The operation of the integrally formed sensor type faucet liquid soap dispenser are explained as follows.

In the present invention, for the faucet main body, the water output port, the liquid soap output port, and the water output sensor window are disposed on the lower surface of the water output end; while the liquid soap output sensor window is disposed on the side surface, the upper surface, or the rear surface of the water output end. In application, when a user extends and reaches his hand on the side surface, the upper surface, or the rear surface, liquid soap output sensor senses the touch generated signal through the liquid soap output sensor window, to trigger liquid soap output. Alternatively, when a user extends and reaches his hand on the lower surface, the water output sensor senses the touch generated signal through the water output sensor window, to trigger water output. In this approach, it is able to provide quite convenience to the user, while keeping the basin table installed neat and clean. In addition, an interlock circuit is provided, so that in case the user first puts his hand on the liquid soap output sensor window, and then the user puts his hand on the water output sensor window, only liquid soap can be released, hereby providing correct and convenient application.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detail descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

Figure 1:
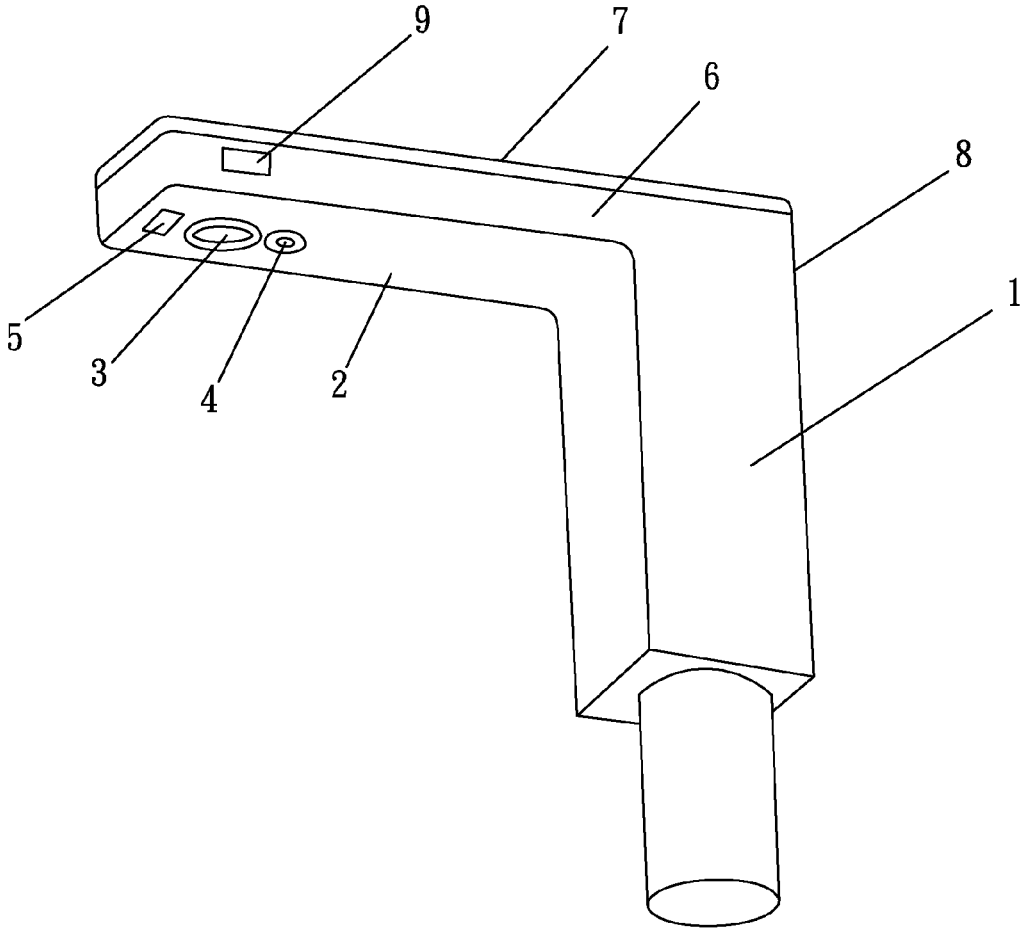
FIG. 1 is a schematic diagram of an integrally formed sensor type faucet liquid soap dispenser according to an embodiment of the present invention.
Figure 2:
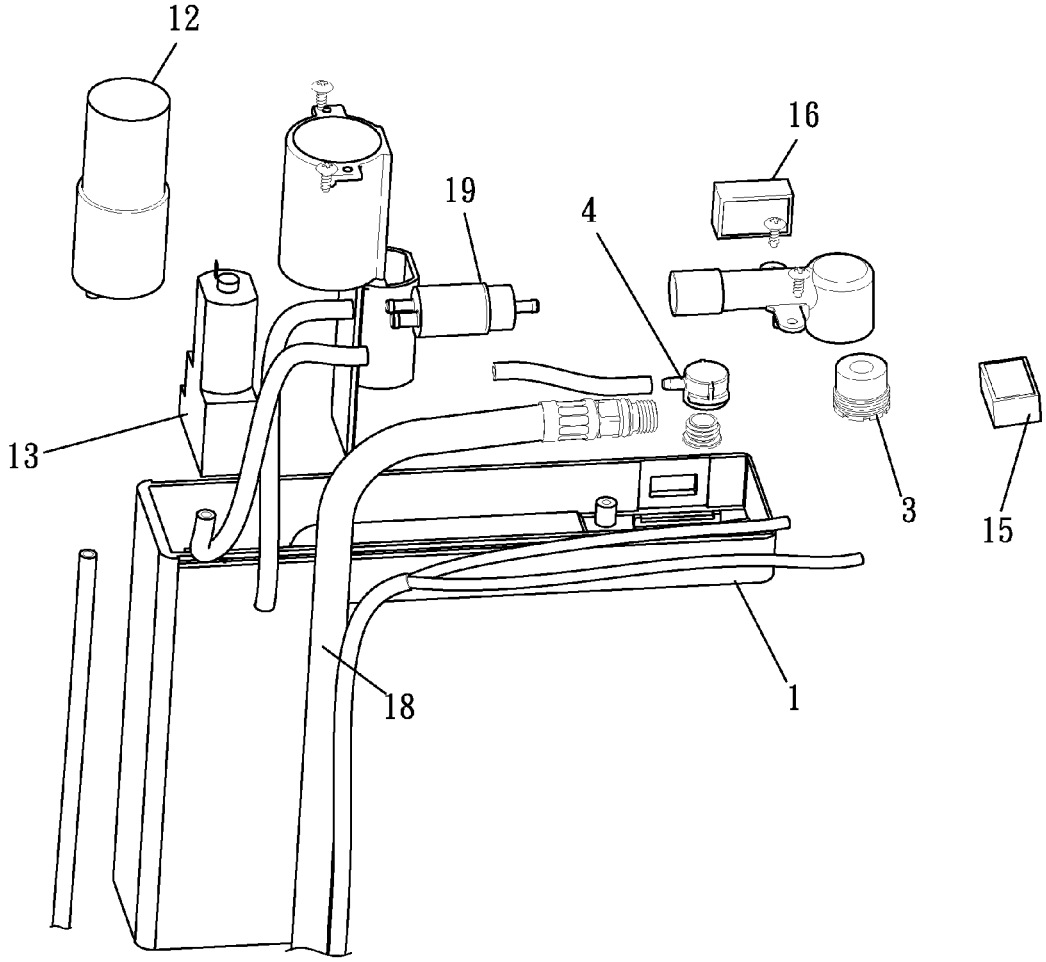
FIG. 2 is an exploded view of an integrally formed sensor type faucet liquid soap dispenser according to an embodiment of the present invention.
Figure 3:
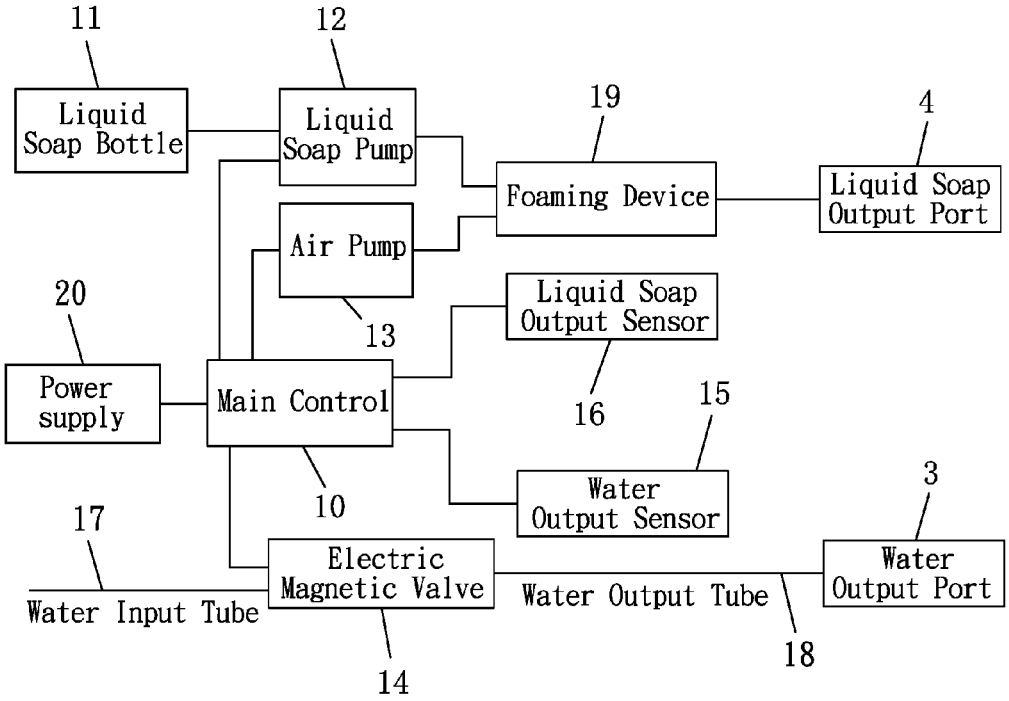
FIG. 3 is a system block diagram of an integrally formed sensor type faucet liquid soap dispenser according to an embodiment of the present invention.

Refer to FIGS. 1 to 3 respectively for a schematic diagram of an integrally formed sensor type faucet liquid soap dispenser according to an embodiment of the present invention; an exploded view of an integrally formed sensor type faucet liquid soap dispenser according to an embodiment of the present invention; and a system block diagram of an integrally formed sensor type faucet liquid soap dispenser according to an embodiment of the present invention.

As shown in FIGS. 1 to 3, the present invention provides an integrally formed sensor type faucet liquid soap dispenser, comprising: a faucet main body 1. The faucet main body 1 includes: a liquid soap pump 12; a liquid soap bottle 11, with its output connected to a first input of the liquid soap pump 12; an air pump 13; a foaming device 19, with its first input connected to an output of the liquid soap pump 12, and with its second input connected to an output of the air pump 13, while an output of the foaming device 19 is connected to a liquid soap output port 4; a liquid soap output sensor 16; a water output sensor 15; a water input tube 17; a water output tube 18, connected to a water output port 3; an electric magnetic valve 14, with its second input connected to the water input tube 17, and with its output connected to the water output tube 18; a main control 10, connected to a second input of the liquid soap pump 12, an input of the air pump 13, an input of the water output sensor 15, an input of the liquid soap output sensor 16, a first input of the electric magnetic valve 14; and a power supply 20, connected to the main control 10.

In an embodiment of the present invention, the faucet main body 1 is provided with an upper surface 7, a lower surface 2, a side surface 6, and a rear surface 8. The faucet main body 1 further includes: a water output sensor window 5, disposed on the lower surface 2 at a water output end of the faucet main body 1, and having the water output sensor 15 provided inside; and a liquid soap output sensor window 9, disposed on the upper surface 7 or the rear surface 8 at the water output end of the faucet main body 1, and having the liquid soap output sensor 16 provided inside. The water output port 3 and the liquid soap output port 4 are both disposed on the lower surface 2 at the water output end of the faucet main body 1, such that the water output port 3 and the liquid soap output port 4 are adapted to output water and liquid soap respectively through using an interlock circuit. As such, water and liquid soap will not be output at the same time.

In the present invention, the interlock circuit is used by the main control 10 to process respectively the water output sensing signal and the liquid soap output sensing signal. When the main control 10 receives the water output sensing signal from the water output sensor 15, it activates the electric magnetic valve 14 to work. And while the electric magnetic valve 14 is working, even if the liquid soap output sensor 16 is triggered, the main control 10 will not activate the liquid soap pump 12 and the air pump 13 to work. Likewise, when the main control 10 receives the liquid soap output sensing signal from the liquid soap output sensor 16, it then activates the liquid soap pump 12 and the air pump 13 to work. And while the liquid soap pump 12 and the air pump 13 are working, even if the water output sensor 15 is triggered, the main control 10 will not activate the electric magnetic valve 14 to work, hereby achieving the advantage that water and liquid soap will not be output simultaneously.

The interlock circuit can be of various types, such as a positive and negative electrical interlock circuit, a relay type interlock circuit, or even an electronic interlock switch.

The power supply 20 utilized in the integrally formed sensor type faucet liquid soap dispenser can be a battery or an outside power source.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An integrally formed sensor type faucet liquid soap dispenser, comprising:

a faucet main body, including:

a liquid soap pump;

a liquid soap bottle, with an output of the liquid soap bottle connected to a first input of the liquid soap pump;

an air pump;

a foaming device, with a first input of the foaming device connected to an output of the liquid soap pump, and with a second input of the foaming device connected to an output of the air pump, while an output of the foaming device is connected to a liquid soap output port;

a liquid soap output sensor;

a water output sensor;

a water input tube;

a water output tube, connected to a water output port;

an electric magnetic valve, with a second input of the electric magnetic valve connected to the water input tube, and with an output of the electric magnetic valve connected to the water output tube;

a main control, connected to a second input of the liquid soap pump, an input of the air pump, an input of the water output sensor, an input of the liquid soap output sensor, a first input of the electric magnetic valve; and a power supply, connected to the main control.

2. The integrally formed sensor type faucet liquid soap dispenser as claimed in claim 1, wherein the faucet main body is provided with an upper surface, a lower surface, a side surface, and a rear surface, further comprising:

a water output sensor window, disposed on the lower surface at a water output end of the faucet main body, and having the water output sensor provided inside; and a liquid soap output sensor window, disposed on the upper surface or the rear surface at the water output end of the faucet main body, and having the liquid soap output sensor provided inside;

wherein the water output port and the liquid soap output port are both disposed on the lower surface at the water output end of the faucet main body, such that the water output port and the liquid soap output port are adapted to output water and liquid soap respectively through using an interlock circuit.

* * * * *